United States Patent [19]

Reineke, Jr. et al.

[11] 4,089,165

[45] May 16, 1978

[54] WATER PRESSURE-POWERED PILE DRIVING HAMMER

[76] Inventors: Harry W. Reineke, Jr., 6001 Dover Pl.; Floydale Teague, 2372 Comet St., both of New Orleans, La. 70114

[21] Appl. No.: 747,871

[22] Filed: Dec. 6, 1976

[51] Int. Cl.[2] ..... F03C 1/00; F01L 7/00

[52] U.S. Cl. ..... 60/369; 60/371; 60/416; 91/315

[58] Field of Search ..... 60/369, 371, 414, 415, 60/416; 91/218, 286, 303, 315, 5

[56] References Cited

U.S. PATENT DOCUMENTS

| | | | |
|---|---|---|---|
| 2,665,551 | 1/1954 | Chenault | 60/414 |
| 2,802,336 | 8/1957 | Ball | 60/371 |

*Primary Examiner*—Edgar W. Geoghegan

*Attorney, Agent, or Firm*—Cushman, Darby & Cushman

[57] ABSTRACT

The piston of a pile driving hammer is raised by hydraulic (water) pressure. As the hammer is permitted to fall, the water pressure is diverted from the cylinder, until the cycle begins again. Pressure surges, upon switching to and from pressure diversion, are turned to advantage by providing large pressure vessels with bag accumulators upstream and downstream of the hydraulic pressure supply pump. The water pressure is selectively throttled to control the frequency and amplitude of the stroke. The pressure vessel may be a pressure tank containing an air cushion. In this way, much of the pressure accumulated or reduced while the pump is working against an isolated pressure vessel acts in concert with the pump to advance the water when the respective pressure vessel is reconnected.

1 Claim, 4 Drawing Figures

WATER PRESSURE-POWERED PILE DRIVING HAMMER

BACKGROUND OF THE INVENTION

During the preparation of this document, the present inventors have become aware of the following prior United States patents and literature article:

| Patentee | Pat. No. | Issue Date |
|---|---|---|
| Dinzl | 2,244,420 | June 3, 1941 |
| De Boysson | 2,253,112 | August 19, 1941 |
| Mercier | 2,290,479 | July 21, 1942 |
| Adams et al | 2,355,357 | August 8, 1944 |
| Stephens | 2,453,732 | November 16, 1948 |
| MacDuff | 2,551,274 | May 1, 1951 |
| Spannhake et al | 3,237,406 | March 1, 1966 |
| Gendron et al | 3,881,557 | May 6, 1975 |

"Dual floating pistons give more bang for buck," Product Engineering, Oct. 12, 1970, page 75.

Although these suggest that it is known to use accumulators in conjunction with pile drivers, our invention makes use of the accumulators in a different way. These others use the fluid to drive a piston attached to a weight, or a piston combined with a weight and use the accumulators merely to dampen the flow.

SUMMARY OF THE INVENTION

Air accumulators are placed in the water delivery and return lines of a water-driven-lift and fall, reciprocating piston-actuated pile driving hammer.

The piston of a pile driving hammer is raised by hydraulic (water) pressure. As the hammer is permitted to fall, the water pressure is diverted from the cylinder, until the cycle begins again. Pressure surges, upon switching to and from pressure diversion, are turned to advantage by providing large pressure vessels with bag accumulators upstream and downstream of the hydraulic pressure supply pump. The water pressure is selectively throttled to control the frequency and amplitude of the stroke. The pressure vessel may be a pressure tank containing an air cushion. In this way, much of the pressure accumulated or reduced while the pump is working against an isolated pressure vessel acts in concert with the pump to advance the water when the respective pressure vessel is reconnected.

Due to the accumulators, the system performs more nearly as if water were a compressible fluid.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 2 is a longitudinal sectional view through the piston-receiving chamber showing much of the modification, with the remaining conventional parts drawn in finer line;

FIG. 3 is a top plan view, the cutting plane of FIG. 2 being indicated thereon by the section line 2—2; and FIG. 4 is an elevation view looking toward the side shown at the left in FIG. 3.

DETAILED DESCRIPTION

Figure 1:
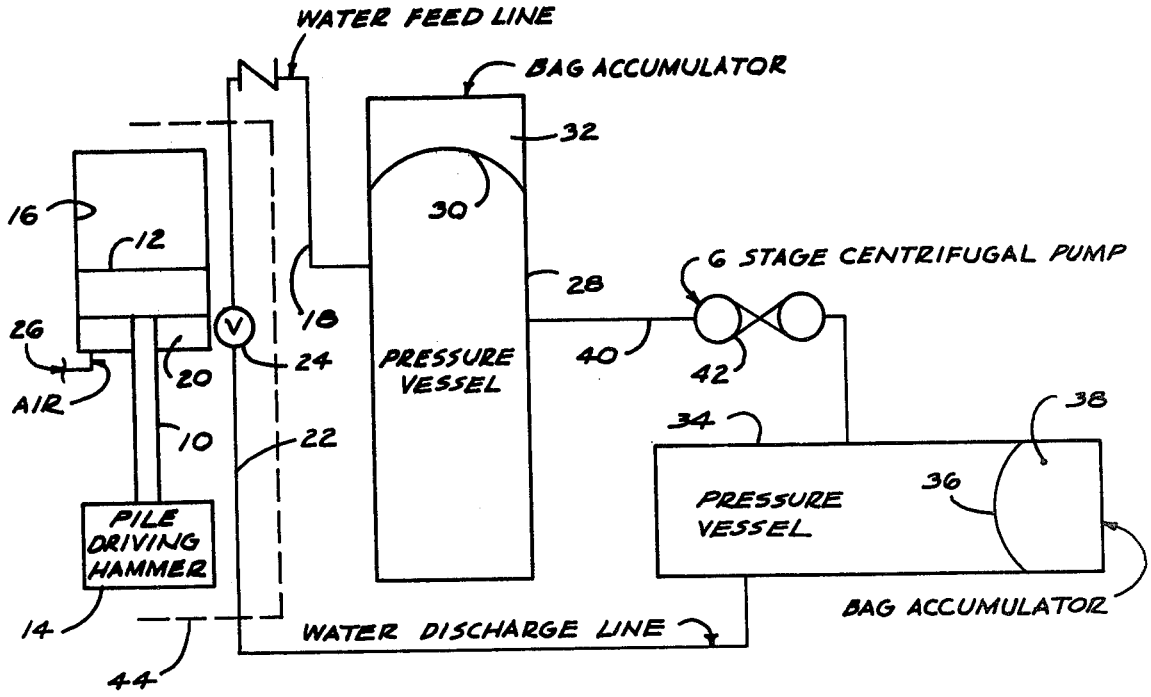
FIG. 1 is a schematic diagram of a pile driving hammer incorporated in an accumulator-aided water pumping system for operating the hammer.

Referring to FIG. 1, the conventional pile driving hammer 14 is connected by a piston rod 10 to a piston 12 vertically slidably received in a cylinder 16.

A water feed line 18 is communicated to water chamber 20 in the cylinder 16 below the piston 12, as is a water discharge line 22. A valve 24 is interposed in the feed and discharge lines in a sense to be movable to a condition for lifting the piston, and thus the hammer. In this first position, the water feed line is in open communication with the water chamber 20 and the water discharge line is isolated from both the water feed line and the water chamber 20.

(A compressed air line 26 is connected to the water chamber for lifting the piston, and thus the pile driving hammer in case of an emergency need to do so, independently of the preferred system.)

The valve 24 is also movable to a second position corresponding to permitting the hammer 14, and thus the piston 12 to fall. In this second position, the water feed line is isolated from both the water chamber 20 and the water discharge line, and the water discharge line is in open communication with the water chamber 20.

The piston/hammer 12, 14 is raised and permitted to fall by switching the valve back and forth between the first and second positions thereof.

In accordance with the present invention, the water feed line leads from a pressure vessel 28 which contains, or is in contact via a flexible wall 30, with an air accumulator or air cushion 32. Further, the water discharge line leads to a pressure vessel 34 which contains, or is in contact via a flexible wall 36 with an accumulator or air cushion 38. Assuming a desired closed circuit of operation, the two pressure vessels 28, 34 are interconnected by a recirculation line 40 and a recirculating pump 42, e.g., a six-stage centrifugal pump, is incorporated in this line.

While the piston 12 is lifting, the water discharge line remains connected through the pressure 34 to the suction side of the pump 42, yet it is disconnected from the water chamber 20 by the valve 24, so the decrease in volume of liquid in the tank 34 is balanced by an increase in the volume contained by the bag accumulator 38.

When the valve 24 is switched and the water discharge line is connected to the water chamber 20, water travels back into the vessel 34 and the air accumulator 38 decreases in volume. This switching of the valve also isolates the water feed line from the water chamber 20 while the water feed line remains connected, through the vessel 28 with the pressure side of the pump 42. This causes the air accumulator bag 32 to be forcibly contracted an amount below its datum volume corresponding to the volume of back-up of water between the valve 24 and the pressure side of the pump 42 until the valve 24 is switched back to the piston/hammer-lifting position.

Figure 3:
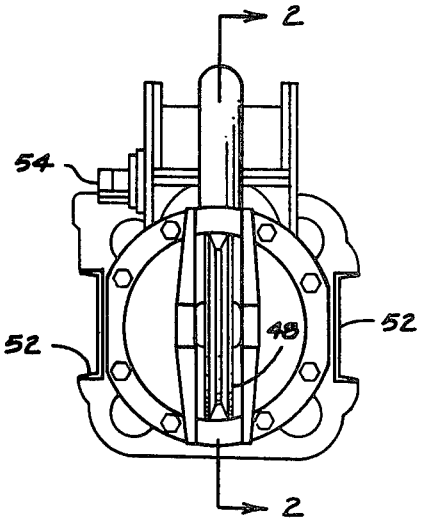
FIGS. 2–4 show an application of the principles of the invention to drive piles with the aid of a former steam-operated pile driving hammer, modified so as to be operated by air-cushioned water pressure.
Figure 4:
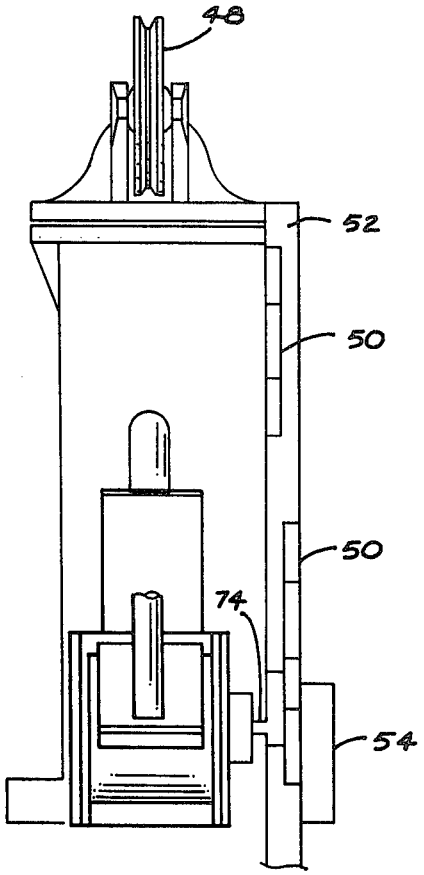

These will now be discussed with respect to FIGS. 2–4, an illustrative, practical embodiment we have designed, for use as the apparatus outlined by the dashed line 44 applied on FIG. 1.

The existing steam pile driver hammer casing 46 is conventionally surmounted with a pulley 48 mounted for rotation about a horizontal axis. This is to lift and hold hammer. A slide (not shown) is connected at one end to a set of counterweights 50 which are keyed to slide up and down in respective tracks 52 on the casing. The counterweights are configured to contact and turn a mechanical switch or valve actuator 54. All of these parts survive from the conversion of the pre-existing steam-operated device and work in the same manner as they did therein, except that the effect of operating the switch 54 is different. In the modified device, the switch 54, when operated, mechanically displaces the valve 24 into the first and second positions thereof.

In the modification, the casing 46 cylinder bore 56 is provided with a tubular sleeve 58, mounted with the aid of annular spacer rings 60. A piston 12 is slidingly received in the bore of the sleeve 58. Further, a valve assembly 62 is fabricated onto the casing 46.

The valve assembly 62 includes a valve 24, comprising a housing 64 and a valve body 66. A water inlet conduit 68 and a water outlet conduit 70 are secured to the valve housing 64 and communicate therethrough to the valve body 66.

Figure 2:
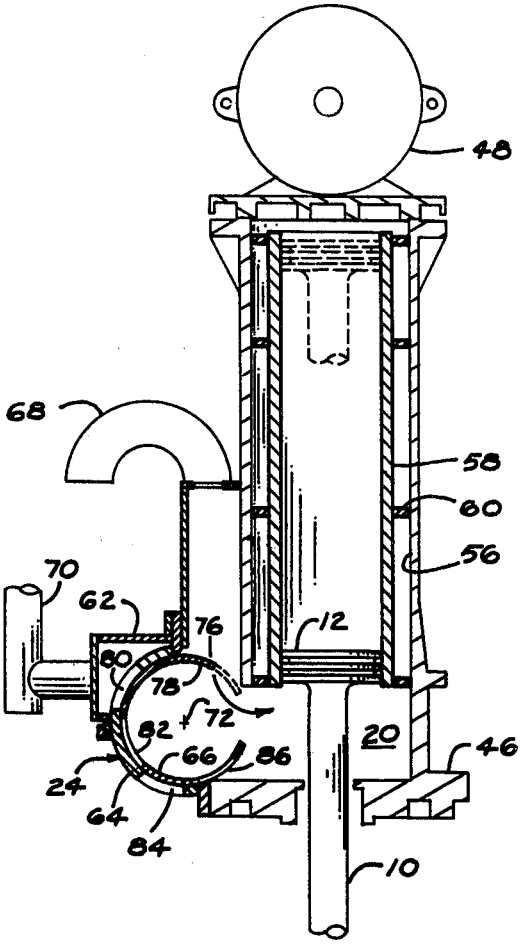

The valve body 66, in the embodiment shown, is a hollow cylinder that is closed at both ends and journalled for rotation about the axis indicated by the cross 72 in FIG. 2. A stem 74 connects the valve body to the switch 54. The valve body 66 is shown in FIG. 2 in its first position in solid lines, and in its second position in dashed lines.

In use, the inlet conduit 68 is connected to the water feed line 18 (FIG. 1) and the water outlet conduit 70 is connected to the water discharge line 22. As the pump 42 operates, with the valve 24 is its first position, water is forced in the direction of arrow 76, into the water chamber 20, causing the piston 12, piston rod 10 and pile driving hammer 14 (FIG. 1) to rise. The counterweights 50 then trip the switch 54 which turns the valve body 66 to its dashed line position. When the valve is in its second position, the portion 78 thereof closes off communication between the inlet 68 and the water chamber 20 and, instead, the water chamber 20 is communicated through the ports 80 and 82, to the water outlet 70. Accordingly, the piston/rod/hammer assembly falls, expelling water in the water chamber 20 into the water discharge line 22.

(A further port 84 is shown provided to align with a further opening 86 in the valve housing only when the valve body is in the second position thereof. The further opening 86 is communicated to Discharge Line 22.)

As a practical example, in the apparatus shown in FIGS. 1–4, the difference in volume of the water chamber 20 when the piston is in the two extreme positions thereof is about 1.2 cubic feet. The pump 42 operates at a rate of 72.0 cubic feet of water per minute, the enclosed volumes of the pressure vessels 28 and 34 are respectively 600 cubic feet and 600 cubic feet, when the accumulators 32 and 38 respectively contain 163 cubic feet of air at 300 p.s.i.g. and 25 p.s.i.g., respectively. The total volume of water in the closed system is 9000 gallons. In many instances, the invention may be practiced using closed dunnage bag-like air pillows at 32 and 38. When true air accumulators are used, they may be of the sort shown at page(s) 1345–1410 of the current, 1976–1977 issue of the Composite Catalog of Oilfield Equipment and Service, Gulf Publishing Co., Houston, Texas. As aforementioned, the frequency and amplitude of the piston stroke is regulated by throttling the water feed. By so doing, the stroke of the embodiment shown may be varied from 30 cycles per minute, 4′–0″ feet long to 60 cycles per minute, 4′–0″ feet long, with the air accumulators satisfactorily storing and giving up the pressure surges resulting from switching. The hydraulic pressure does not exceed 300 p.s.i.g. in the system.

It should now be apparent that the water pressure-powered pile driving hammer, as descirbed hereinabove, possesses each of the attributes set forth in the specification under the heading "Summary of the Invention" hereinbefore. Because the water pressure-powered pile driving hammer can be modified to some extent without departing from the principles of the invention as they have been outlined and explained in this specification, the present invention should be understood as encompassing all such modification as are within the spirit and scope of the following claim.

What is claimed is:

1. For a drop hammer, a water-powered, cyclically operating hammer raising system comprising:

(a) an upright cylinder;
(b) a piston slidable in the cylinder;
(c) a piston rod connected to the piston and arranged for connection with the hammer;
(d) a continuously operating water pump;
(e) a first pressure vessel;
(f) a second pressure vessel;
(g) a conduit continuously communicating between the first and second pressure vessels and incorporating the water pump in a sense to continuously pump water from the first pressure vessel into the second pressure vessel;
(h) a valve assembly including a valve housing and a valve body mounted in the valve housing for movement between a first position and a second position;
(i) a water inlet conduit through the housing to the valve body;
(j) a water outlet conduit from the valve body through the valve housing;
(k) a water feed line continuously connecting the water inlet conduit to the first pressure vessel;
(l) a water discharge line continuously connecting the water outlet conduit to the second pressure vessel;
(m) the valve body having port means which, when the valve is in said first position, communicate the water inlet conduit with the cylinder below the piston and isolate the water outlet line from the cylinder below the piston and which, when the valve is in said second position, communicate the water outlet conduit with the cylinder below the piston and isolate the water inlet line from the cylinder below the piston;
(n) means for cyclically switching the valve body between said first and second positions thereof; and
(o) first and second sealed, air-containing resilient cushion means associated with the respective first and second pressure vessels via flexible dividing wall means, so that when the respective pressure vessel is temporarily isolated from the respective water inlet or outlet conduit, the respective flexible wall may resiliently distend as the volume of contained-air correspondingly changes, and may resiliently recover, effectively aiding the pump, when the respective temporary isolation ends.

* * * * *